US012662175B2

(12) United States Patent
Horn et al.

(10) Patent No.: US 12,662,175 B2
(45) Date of Patent: Jun. 23, 2026

(54) DEVICE AND METHOD FOR DETERMINING A SPEED OF A RAIL-BASED VEHICLE

(71) Applicant: ZF Friedrichshafen AG, Friedrichshafen (DE)

(72) Inventors: Susanne Horn, Tettnang (DE); Axel Mors, Friedrichshafen (DE); Adam Norris, Friedrichshafen (DE); Jens Giesler, Friedrichshafen (DE); David Stock, Friedrichshafen (DE); Tobias Dentler, Meckenbeuren (DE); Christian Carl, Langenargen (DE); Michael Hertkorn, Bodolz (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 38 days.

(21) Appl. No.: 18/613,684

(22) Filed: Mar. 22, 2024

(65) Prior Publication Data

US 2024/0317282 A1 Sep. 26, 2024

(30) Foreign Application Priority Data

Mar. 24, 2023 (DE) ..... 102023202708.9

(51) Int. Cl.
*B61L 25/02* (2006.01)
*B61L 15/00* (2006.01)

(52) U.S. Cl.
CPC ..... *B61L 25/021* (2013.01); *B61L 15/0081* (2013.01); *B61L 25/025* (2013.01); *B61L 2205/04* (2013.01)

(58) Field of Classification Search
CPC .. B61L 25/021; B61L 15/0081; B61L 25/025; B61L 2205/04; B61L 15/0072
See application file for complete search history.

(56) References Cited

U.S. PATENT DOCUMENTS 9,842,438 B1 * 12/2017 Bradley ..... G07C 5/0816
11,295,241 B1 * 4/2022 Badawy ..... G06N 5/022
(Continued)

FOREIGN PATENT DOCUMENTS

DE 102012200087 A1 7/2013
DE 102014226612 A1 6/2016
(Continued)

OTHER PUBLICATIONS

German Search Report Corresponding to Application No. 102023202708.9 on Oct. 24, 2023.

*Primary Examiner* — Kurt Philip Liethen
(74) *Attorney, Agent, or Firm* — Dority & Manning, P.A.

(57) ABSTRACT

A device (9) for determining a speed of a rail-based vehicle with wheels on a predetermined network of routes includes an interface (8) for collecting one-dimensional or multi-dimensional vibration data (5) corresponding to vibrations of at least one wheel acting on the rail-based vehicle as an acceleration of the rail-based vehicle. The vibrations are detectable using at least one wireless sensor (2*a*, 2*b*, 2*c*, 2*d*) arranged proximate the at least one wheel. A learning module is configured to apply a trained machine-learned model to the vibration data to determine a ground speed. The trained machine-learned model is trained based on a distance traveled and a ground truth speed (17) and a corresponding portion of the vibration data (5).

19 Claims, 7 Drawing Sheets

(56) References Cited

U.S. PATENT DOCUMENTS

| | | | | |
|---|---|---|---|---|
| 12,061,170 | B2 * | 8/2024 | Xie | E21F 17/18 |
| 2005/0107954 | A1 * | 5/2005 | Nahla | B61L 25/023 701/19 |
| 2007/0291958 | A1 * | 12/2007 | Jehan | G10H 1/0025 381/103 |
| 2015/0193992 | A1 * | 7/2015 | Kumar | G07C 5/0808 701/29.2 |
| 2020/0324795 | A1 * | 10/2020 | Bojarski | G05D 1/0274 |
| 2021/0078619 | A1 * | 3/2021 | Morita | B61L 15/0027 |
| 2021/0122402 | A1 * | 4/2021 | Böhm | B61L 23/045 |
| 2023/0356763 | A1 * | 11/2023 | Vorren | B61L 25/021 |

FOREIGN PATENT DOCUMENTS

| | | | | |
|---|---|---|---|---|
| EP | 1981748 | B1 | 11/2012 | |
| GB | 2516663 | A | 2/2015 | |
| WO | WO-2021155950 | A1 * | 8/2021 | G06N 3/045 |

* cited by examiner

| Wheel dameter in mm | 715 | 635 | 0 |
|---|---|---|---|
| Ground Speed [km/h] | 1. toothing frequency | 1. toothing frequency | Difference in HZ |
| 5 | 81,6 | 91,9 | 10,3 |
| 10 | 163,2 | 183,8 | 20,6 |
| 20 | 326,5 | 367,6 | 41,1 |
| 30 | 489,7 | 551,4 | 61,7 |
| 40 | 652,9 | 735,2 | 82,3 |
| 50 | 816,2 | 919,0 | 102,8 |
| 60 | 979,4 | 1102,8 | 123,4 |

Fig. 8

DEVICE AND METHOD FOR DETERMINING A SPEED OF A RAIL-BASED VEHICLE

CROSS-REFERENCE TO RELATED APPLICATION

The present application is related and has right of priority to German Patent Application No. DE102023202708.9 filed on Mar. 24, 2023, which is incorporated by reference in its entirety for all purposes.

TECHNICAL FIELD

The invention relates generally to a device for determining a speed of a rail-based vehicle with wheels on a predetermined network of routes.

BACKGROUND

There are many measuring devices for contactlessly determining the speed of rail vehicles. These measuring devices can be based, for example, on the detection of the wheel rotation, radar measurements or satellite navigation systems as well as on acceleration sensors.

In addition, optical systems can be used for measuring speed. Some of these systems can also be used for automatically detecting signals, signs or beacons in order to transmit route signals to the vehicle.

Speed can be measured in trains, for example, using a Doppler RADAR system or by evaluating wheel rotations per unit of time.

Typical methods such as wheel rotation additionally have the disadvantage of slip effects. An evaluation of wheel rotations per unit of time is also expensive and, therefore, is not always used in the streetcar sector.

The use of radar measurements on the basis of the Doppler effect requires technically challenging transmission and receiving mechanics combined with real-time capable microprocessor technology or signal processing technology. This use leads to considerable costs. The use of high-frequency radio signals can also interfere with other systems. In addition, the form of the reflected signal depends on the reflective properties of the surface. This can result in faults during travel over wet surfaces.

A more favorable method is to measure the speed and thus determine the position of a train via GPS.

Satellite navigation systems such as GPS systems can provide highly precise information regarding position and speed. Since the satellite signals must be received without interference, however, the use in constructions, for example, tunnels and halls, is not readily possible. The satellite signals therefore do not provide data for underground travel.

Optical systems have the disadvantage that, in order to detect changes in the surface in order to determine the speed, sufficient illumination and, in addition, an appropriate optical system must be present. This can result in problems during operation, for example, due to the device becoming soiled.

In rail traffic, balises, for example, the Eurobalise, can be used, which wirelessly communicate with the train and transmit route information when the train passes thereover. Since these balises are not sufficiently frequently installed, the possibility of determining the speed on the basis of the time difference of the travel thereover is limited.

DE 102012200087 A1 discloses a method and device for the object-side determination of location-related data and/or movement data, in particular speed data, of a moving object, in particular of a rail vehicle, wherein location-specific parameters of the natural geomagnetic field are evaluated.

EP 1981748 B1 discloses a system for determining the speed of a train, which includes: an image capture device to be mounted on the train in a position in which the image capture device can capture a sequence of images of the surroundings ahead of or behind the train; and an image processor, for processing the images captured by the image capture device, wherein the image processor processes the sequence of images by transforming each captured image of the surroundings ahead of or behind the train, thus yielding an image which is directed downward onto the tracks, and the speed of the train is derived from the detectable movement of objects in the transformed images.

BRIEF SUMMARY

Example aspects of the invention provide an improved device and an improved method for contactlessly determining a speed of a rail-based vehicle such that the aforementioned problems are avoided or reduced.

Example aspects of the present disclosure provide a device for determining a speed of a rail-based vehicle with wheels on a predetermined network of routes, the device including an interface for collecting one-dimensional or multi-dimensional vibration data as vibration, of at least one wheel, acting on the rail-based vehicle, as an acceleration of the rail-based vehicle, the vibrations being detectable using at least one wireless sensor, which is arranged in the region of the at least one wheel, wherein a learning module is provided, which is designed to apply a trained machine learning method to the vibration data to determine the ground speed, wherein the machine learning method is trained on the basis of a distance traveled and a ground truth speed and the corresponding portion of the vibration data.

Vibration data are to be understood as the collected raw time data of the sensor. This means that the time is also recorded along with the vibration data, i.e., the vibration data are coupled to or associated with the time.

A ground truth speed, i.e., the real ground speed, can be determined, for example, when passing through such a region while incorporating the rail segment traveled and the time by determining the GPS positions (GPS data) of the rail-based vehicle. On the basis of the GPS positions, the distance traveled, which is known from the network of routes, and the time, the GPS speed can be subsequently determined as a ground truth speed.

In a rail-based vehicle, a vibration in a vertical direction, for example, of a running wheel imbalance or a deviation of the perimeter of a running wheel from the shape of a circle, characterizes the current acceleration of the rail vehicle. These can be measured as vibration data.

A trained machine learning method is, for example, a neural network. If the spectrogram is pictorial, in particular, a convolutional neural network can be used.

A network of routes is a route on which the rail-based vehicle travels.

In particular, the wireless sensor can be in the form of a radio sensor, which is arranged on the transmission or on the bogie of the rail-based vehicle, for example, a train.

Using the device according to example aspects of the invention, a ground speed can also be calculated underground, i.e., in tunnels, for example, in the case of subways, etc. This bridges the gap to the GPS positions, on the basis of which the speed can only be determined above ground.

The determination of the ground speed on the basis of the vibration data and a machine learning method can be used to monitor rails (rail position) and to monitor the train (train radar) even when a GPS signal is not present.

Known route features can be taken into account. This allows, for example, for stops to be detected on the basis of a comparison with map data. Accelerations are very low at a stop, i.e., when the train is at a standstill. The accelerations can be derived from the vibration data and, when a route is known, can be associated with a position.

The ground speed of a train can be derived from the vibration data by the machine learning method, such as a neural network.

The device can be formed, for example, on a cloud/external server in order to monitor multiple trains.

Furthermore, using the device, a wheel/rail position can also be detected during temporary GPS failures or when GPS data quality is poor, such as, for example, when there is a drift of the position.

In another example embodiment, a computing unit is provided, the computing unit being designed to apply an acoustic analysis to the vibration data in order to generate a raw spectrogram and to apply filtering to the raw spectrogram and, after the filtering, to apply normalization in order to generate an acceleration spectrogram, and wherein the machine learning method is trained to be applied to the acceleration spectrogram in order to determine the ground speed.

A raw spectrogram is a spectrogram with the unprocessed vibration data as a frequency spectrum. An acceleration spectrogram can be understood to be the filtered and normalized raw spectrogram.

In order to apply the machine learning method, the vibration data can preferably be filtered in order to smooth wide-band interfering noises and interferences that are independent of the speed. As a result, effects that are independent of the speed can be filtered out. Thereafter, the data are preferably normalized. These interferences that are independent of the speed arise, for example, due to superelevations and tilting of the train during changing rises and falls of the rail, which occur, for example, at the beginning of uphill or downhill travel.

In particular, the computing unit can apply, after the filtering, a normalization in order to generate an acceleration spectrogram on the basis of the time-resolved, normalized vibration data. In particular, the machine learning method can be trained to be applied to the acceleration spectrogram.

In another example embodiment, the computing unit is designed to form a short-time Fourier transform (STFT) as an acoustic analysis of the raw spectrogram and/or the acceleration spectrogram. The STFT is represented, in particular, as a pictorial diagram. In particular, this representation with a convolutional neural network is suitable as a machine learning method, such as a convolutional neural network, which is particularly well suited for a pictorial representation such as the STFT.

Furthermore, the device is designed to receive the GPS positions of the rail-based vehicle. The device can also determine a ground truth speed on the basis of the GPS positions.

On the basis of the GPS positions, the distance traveled, which is known from the network of routes, and the time, the GPS speed can be subsequently determined as a ground truth speed. As a result, the ground truth speed can be easily determined.

Alternatively or additionally, the device is designed to generate the corresponding ground truth speed when the rail-based vehicle is passing through position alarm points and a ground truth speed which can be calculated on the basis thereof.

Position alarm points can be, for example, geofence points or a geofence region. These can form a region in that, for example, a GPS signal can be well received by the rail-based vehicle, also in combination with balises, the positions of which are known.

In particular, wireless sensors can be arranged at each of the wheels in order to collect the one-dimensional or multi-dimensional vibration data of each wheel. The wireless sensors can, for example, wirelessly transmit the collected vibration data into the cloud. Furthermore, an onboard telematics gateway can also be provided, which is arranged on the rail-based vehicle and receives the GPS positions during travel above ground or at least in the geofence points/geofence regions (position alarm points) and the vibration data of each wheel and wirelessly transmits these, bundled, for example, with a time stamp, to the cloud. Transmission paths can be taken into account, for example, in the subsequent determination of the ground speed.

In particular, the learning module can be designed to continuously retrain the already trained machine learning method on the basis of the determined ground speed and the ground truth speed. As a result, the fact that a different ground speed results due to wear of the rails/wheels in the course of the operation of the rail-based vehicle is taken into account. Due to the continuous retraining of the machine learning method, a precise ground speed and a precise wheel/rail position can therefore always also be achieved in tunnels and underground.

In another example embodiment, the computing unit is designed to determine a wheel/rail position on the basis of the network of routes and the required time and the determined ground speed.

On the basis of the wheel/rail position and, for example, abnormalities in the vibration data, abnormalities in the rails can also be determined, for example, in tunnels/underground, with positional precision and, therefore, can be quickly checked and observed. This is advantageous, in particular, for subways, which also travel relatively long distances underground.

In another example embodiment, the computing unit is designed to apply a high-pass filter and/or a low-pass filter and/or a bandpass filter and/or a median filter as filtering.

In particular, the computing unit is designed to apply a median filter as filtering. Furthermore, the computing unit can be designed to apply a bandpass filter prior to the median filter as filtering. The median filtering smooths the occurring wide-band interfering noises and interferences that are independent of the speed. Thereafter, the data are normalized. Therefore, better results, i.e., a more precise determination of the ground speed, can be achieved.

In another example embodiment, the machine learning method is trained on the basis of a distance traveled and the corresponding ground truth speed and the corresponding portion of the vibration data, wherein the ground truth speed can be generated, in particular, when the rail-based vehicle is passing through GPS position alarm points and a ground truth speed which can be calculated on the basis thereof, on the basis of transmitted GPS positions or merely on the basis of the GPS positions of the rail-based vehicle. The position alarm points can be in the form of geofence regions in which a GPS ground speed can be detected. These are used as ground truth GPS data to train the machine learning method, in particular the neural network, and to update (retrain) a trained neural network. As a result, simple training data can be generated, on the basis of which the neural network can be trained.

The machine learning method can preferably be in the form of a convolutional network with a formation of the time-resolved, normalized vibration data as an acceleration spectrogram. The machine learning method can also be applied to the time-resolved vibration data without further processing. As a result, training data can be easily generated and the machine learning method can be easily trained. During operation, the machine learning operation can be kept updated with the ground truth speeds.

Furthermore, example aspects of the present disclosure provide a method for determining a ground speed of a rail-based vehicle with wheels on a predetermined network of routes, including:

detecting an acceleration of the rail-based vehicle as one-dimensional or multi-dimensional vibration data due to vibrations, of at least one of the wheels, acting on the rail-based vehicle by a wireless sensor, which is arranged in the region of the at least one wheel; and applying a trained machine learning method to the vibration data to determine a ground speed, wherein the machine learning method is trained on the basis of a distance traveled and a corresponding ground truth speed and the corresponding portion of the vibration data.

The method can be designed, in particular, to run on a device according to example aspects of the invention, in particular a cloud.

Such a method can receive the vibration data and a time stamp, preferably from all wheels, by an onboard telematics gateway which is simultaneously designed to receive, for example, the GPS positions of the rail-based vehicle during travel above ground. On the basis of the GPS positions, the distance traveled, which is known from the network of routes, and the time, the GPS speed can be subsequently determined as a ground truth speed.

In another example embodiment, the method further includes:

applying an acoustic analysis to the vibration data, in order to generate a raw spectrogram, and a filtering to the raw spectrogram and, after the filtering, applying a normalization in order to generate an acceleration spectrogram, and wherein the machine learning method is trained to be applied to the acceleration spectrogram in order to determine the ground speed.

Furthermore, the corresponding ground truth speed can be generated when the rail-based vehicle is passing through position alarm points and a ground truth speed which can be calculated on the basis thereof.

Position alarm points can be, for example, geofence points or a geofence region.

A trained machine learning method is, for example, a neural network. If the spectrogram is pictorial, in particular, a convolutional neural network can be used.

A network of routes is a route on which the rail-based vehicle travels.

Using the method according to example aspects of the invention, ground speed can also be calculated underground, i.e., in tunnels, for example, in subways, etc. This bridges the gap to the GPS positions, on the basis of which the speed can only be determined above ground.

The extraction of the ground speed from the acceleration diagram is used to monitor rails (rail position) and to monitor the train (train radar) also when a GPS signal is not present.

Furthermore, a wheel/rail position can be determined on the basis of the ground speed and the network of routes and the required time. On the basis of the wheel/rail position and, for example, abnormalities in the vibration data, abnormalities in the rails can also be determined, for example, in tunnels, with positional precision and, therefore, can be quickly checked and observed.

In another example embodiment, a high-pass filter and/or a low-pass filter and/or a bandpass filter and/or a median filter can be applied as filtering. In this way, the vibration data can be better prepared.

In another example embodiment, the acceleration is detected as vibration data from all wheels using a wireless sensor which is arranged in the region of each wheel. Thereafter, the wheel/rail position of each wheel can be determined.

Furthermore, the machine learning method can be continuously retrained on the basis of the determined ground speed and the ground truth speed. As a result, the fact that a different ground speed and thus a different wheel/rail position results due to wear of the rails/wheels in the course of the operation of the rail-based vehicle is taken into account.

In another example embodiment, the ground truth speed is generated on the basis of transmitted GPS positions. Furthermore, the GPS positions can be temporally linked to the acceleration diagram by a telematics gateway. Thereafter, the sensor data of each wheel can be transmitted together with a time stamp and the GPS positions to a cloud/external computer in order to generate the ground speed and to retrain the machine learning method.

Furthermore, the method may include:

determining at least one current speed-dependent parameter, which is used to calculate the wheel diameter, on the basis of the vibration data, preferably on the basis of the acceleration spectrogram of the at least one wheel; and determining wear by a comparison with the corresponding original speed-dependent parameters for an original wheel diameter, wherein the current speed-dependent parameter and the original speed-dependent parameter are both based on the same or approximately the same ground speed.

As a current speed-dependent parameter, for example, the toothing frequencies of a transmission and/or wheel frequencies (angular wheel frequencies) of the at least one wheel can be used, wherein the wear of the at least one wheel is determined on the basis of a frequency shift in the vibration data.

After the wheels become worn, the wheels must rotate faster in order to truely have the same ground speed as prior to the wear. This yields a frequency shift in the vibration data.

To this end, at the same ground speed, the vibration data with original wheel diameters are compared with the acceleration spectra of the respective same wheels at the same ground speed, the acceleration spectra occurring the journeys. When wear is present, a computational shift of the frequencies in the spectrum therefore occurs, since, due to the wear, the wheels must now rotate faster in order to reach the desired ground speed. The wheel diameter is determined from the deviation of the frequencies. The machine learning method can also be used in order to estimate the existing wheel diameter with respect to an original wheel diameter.

In particular, the original wheel diameter can be, for example, the wheel diameter of a new wheel.

BRIEF DESCRIPTION OF THE DRAWINGS

Further example properties and advantages of the present invention are obvious from the following description with reference to the attached figures, wherein schematically:

FIG. 8: schematically shows the detection of wear of a wheel; and

DETAILED DESCRIPTION

Figure 1:
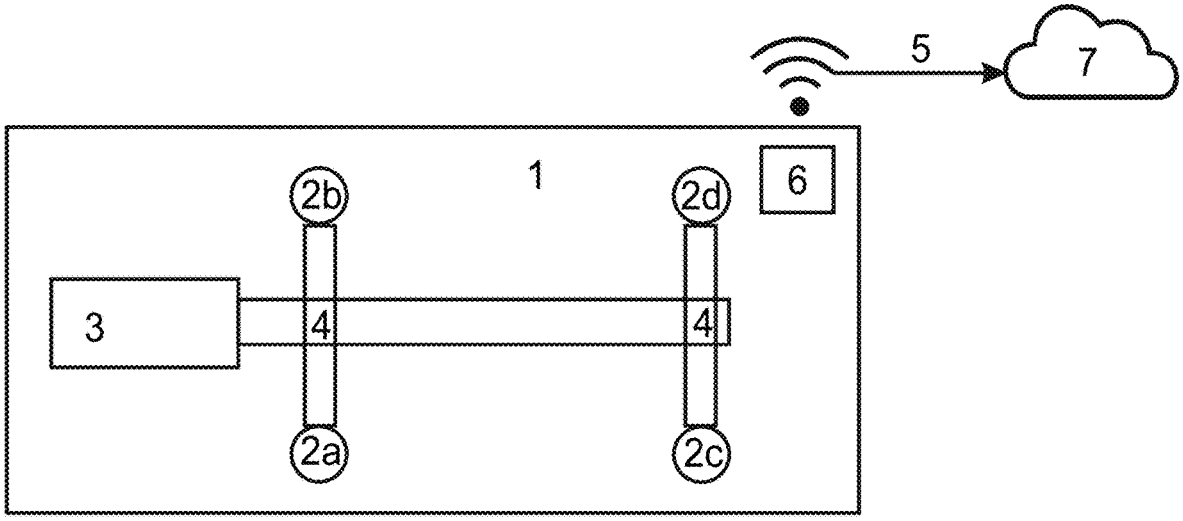
FIG. 1: shows a train according to example aspects of the invention.

Reference will now be made to embodiments of the invention, one or more examples of which are shown in the drawings. Each embodiment is provided by way of explanation of the invention, and not as a limitation of the invention. For example, features illustrated or described as part of one embodiment can be combined with another embodiment to yield still another embodiment. It is intended that the present invention include these and other modifications and variations to the embodiments described herein.

It is known that a speed of a train can be measured and thus the position of a train can be determined via GPS. Since the satellite signals must be received without interference, however, the use in constructions, for example, tunnels and halls, is not readily possible. Therefore, speed cannot be measured via GPS during underground journeys.

FIG. 1 shows a train 1 as a rail-based vehicle. The train 1 has a wireless sensor 2*a*, 2*b*, 2*c*, 2*d* at each wheel, in the vicinity of the wheel.

The wireless sensors 2*a*, 2*b*, 2*c*, 2*d* can be arranged, for example, on the transmission 3 or on the bogie 4 and data can be transmitted by radio or Bluetooth.

The wireless sensors 2*a*, . . . , 2*d* record data, such as accelerations, during the journey as one-dimensional or multi-dimensional vibration data 5, temperature data and tilt behavior as well as abnormalities in the wheel-rail contact.

The vibration data 5 of each wheel are transmitted to a telematics gateway 6, which is arranged on the train 1.

The telematics gateway 6 can transmit the vibration data 5, including a time stamp, to an external server, which is a cloud 7 in this case. Alternatively, the data can also be transmitted to a computer which is located in the train 1, for processing.

Furthermore, the telematics gateway 6 can detect the GPS positions of the train 1 as the train 1 travels above ground. Such a detection can be carried out in geofence regions with geofence points (position alarm points). A geofence region or geozone is a virtual fence around a physical region in that here, for example, the GPS positions can be precisely detected.

The GPS positions can also be transmitted to the cloud 7 with the corresponding vibration data 5. GPS reception is not possible during underground journeys, however.

The cloud 7 has an interface 8 for receiving the data.

Figure 2:
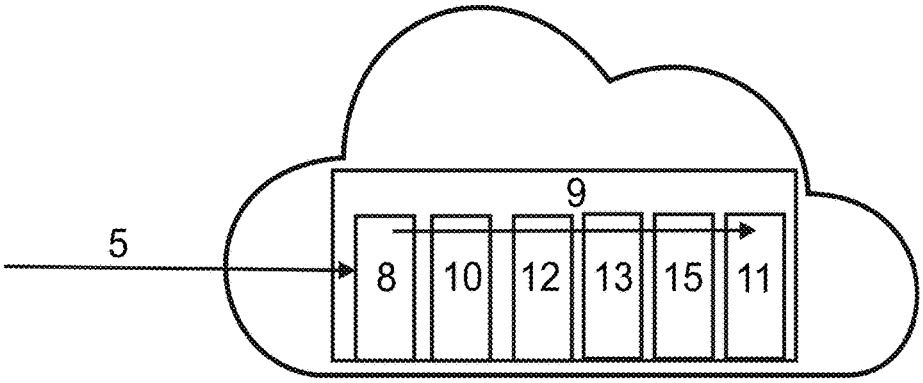
FIG. 2: schematically shows the device and the method in the cloud.

FIG. 2 schematically shows the device 9 and the method in the cloud 7.

The cloud 7 receives the vibration data 5 by the interface 8 and stores these data in a computing unit. In the computing unit, an acoustic analysis, such as, for example, a Fourier transform, is applied to the vibration data 5 in order to generate a raw spectrogram 10 (FIG. 3).

Figure 3:
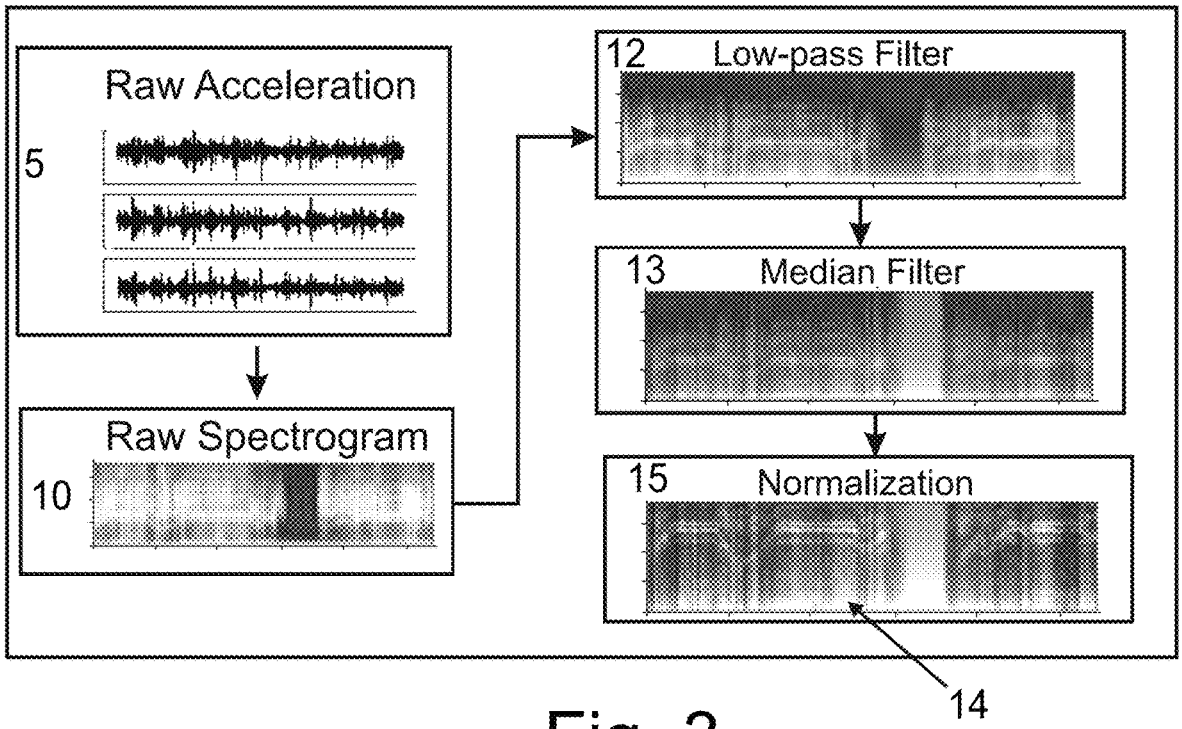
FIG. 3: shows the received vibration data and the filtering.

FIG. 3 shows the received vibration data 5 and the raw spectrogram 10.

Furthermore, the device 9 as well as the method have a learning module with a machine learning method, which is a convolutional network in this case, in particular a convolutional neural network 11, which is designed to determine the ground speed of the train 1 on the basis of the vibration data 5. The convolutional neural network 11 is particularly well suited for a pictorial representation, such as spectrograms.

To this end, initially a bandpass filter 12 and, thereafter, a median filter 13 are applied to the raw spectrogram 10. Thereafter, normalization 15 is applied to the time-resolved, filtered vibration data 5 in order to generate an acceleration spectrogram 14.

Thereafter, the convolutional neural network 11 is applied to the acceleration spectrogram 14.

The convolutional neural network 11 is designed to determine the current ground speed on the basis of the acceleration spectrogram 14 by utilizing the time and the network of routes.

A previous filtering is carried out in order to eliminate the signal components in the measurement, which are due to effects which are independent of the speed.

These effects can arise due to superelevations and tilting of the train during changing rises and falls of the rail, which occur, for example, at the beginning of uphill or downhill travel.

Figure 4:
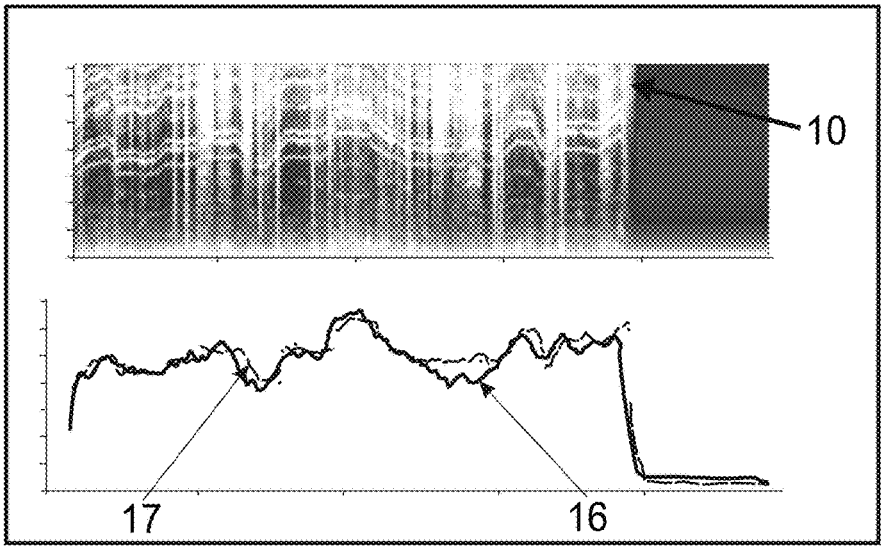
FIG. 4: shows the input of an unfiltered acceleration spectrogram into the convolutional neural network.

FIG. 4 shows this discrepancy as a diagram on the basis of an input of an unfiltered raw spectrogram 10 into the convolutional neural network 11 and the ground speed (prediction 16 in the figures), which is determined by the convolutional neural network 11, and the GPS speed as a ground truth speed 17.

A deviation between the ground truth speed 17 and the ground speed (prediction 16) is apparent.

The convolutional neural network 11 (FIG. 5) is trained to determine the current ground speed on the basis of the acceleration spectrogram 14 by utilizing the time and the network of routes and a ground truth speed 17. To this end, the GPS positions are initially received by the telematics gateway 6 as the rail-based vehicle passes through position alarm points and are transmitted to the cloud 7. Position alarm points are designed as geofence regions with geofence points. A geofence region or geozone is a virtual fence around a physical region in that here, for example, the GPS positions can be precisely detected.

This geofence region is above ground in this case, since reception is not possible in a tunnel. Thereafter, the ground truth speed 17 and the corresponding acceleration spectrogram 14 can be used to train the convolutional neural network 11 to determine a ground speed.

Using the trained convolutional neural network 11, a ground speed can now be determined merely on the basis of the acceleration spectrogram 14 and the time and the distance traveled, specifically also in tunnels, in which GPS reception is not possible.

The estimation of speed is also used to locate the train 1 and/or to estimate the position of the train 1 and/or to determine a wheel/rail position for the purpose of rail monitoring. On the basis of the wheel/rail position and, for example, abnormalities in the vibration data 5, abnormalities in the rails can also be determined, for example, in tunnels, with positional precision and, therefore, can be quickly checked and observed. This is advantageous, in particular, for subways, which also travel relatively long distances underground. Furthermore, with this method, a wheel/rail position can also be applied during temporary GPS failures or when GPS data quality is poor, such as, for example, when there is a drift of the position.

Furthermore, the convolutional neural network 11 can be continuously retrained by the GPS speed as a ground truth speed 17. As a result, the fact that a different ground speed and thus a different wheel/rail position result due to wear of the rails/wheels in the course of the operation of the rail-based vehicle is taken into account. Due to the continuous retraining of the machine learning method, a sufficiently precise ground speed and thus a precise wheel/rail position can therefore always also be achieved in tunnels/underground.

The ground truth speed 17 can be generated on the basis of position alarm points. Other options are also possible, however.

Therefore, the GPS speed which has been recorded in the geofence regions can be used for training and for retraining.

Figure 5:
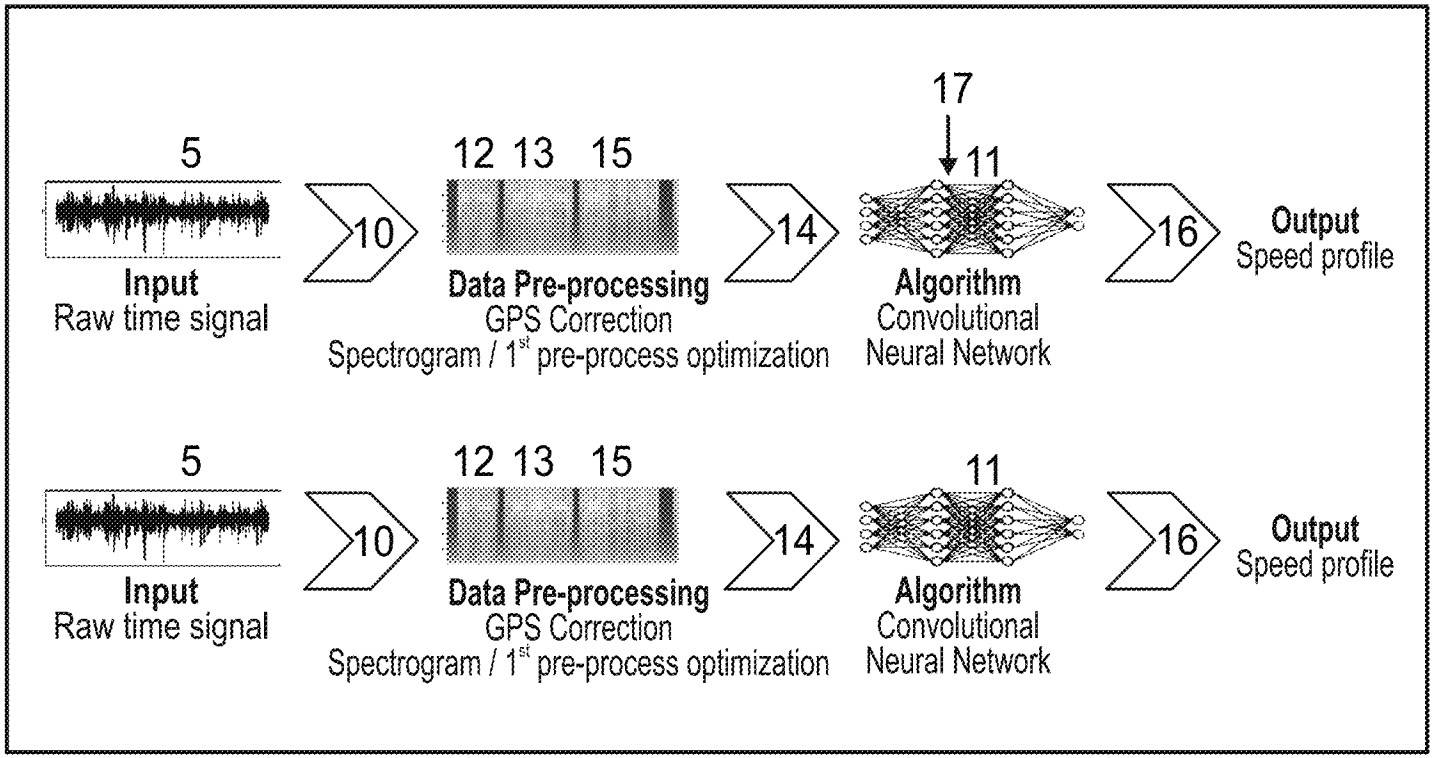
FIG. 5: schematically shows a retraining.

FIG. 5 schematically shows such a continuous retraining. Such retraining can be carried out continuously or only after a predetermined number of kilometers traveled.

Initially, the vibration data 5 are recorded by wireless sensors 2*a*, . . . , 2*d* and transmitted to a cloud 7 by a telematics gateway 6.

Furthermore, in geofence regions, the GPS positions are recorded and transmitted to the cloud 7. In the cloud 7, on the basis of the GPS positions, a GPS speed is used as a ground truth speed 17. There, the vibration data 5 are processed via filtering and normalization to form an acceleration spectrogram 14. The acceleration spectrogram 14 can be in the form of a short-time Fourier transform (STFT) and/or another analysis or transformation method.

Thereafter, the ground speed can be determined by the acceleration spectrogram 14 and the convolutional neural network 11. The convolutional neural network 11 can be continuously compared and retrained on the basis of the ground truth speed 17 and the corresponding portion of the acceleration spectrogram 14. As a result, it is permanently ensured that a sufficiently precise ground speed can be determined. The wheel/rail position can be determined on the basis of the ground speed.

If the train 1 is located in a tunnel (lower figure), GPS positions cannot be detected by the telematics gateway 6.

The ground speed of the train 1 and the wheel/rail position are determined on the basis of the acceleration spectrogram 14 and the convolutional neural network 11.

Figure 6:
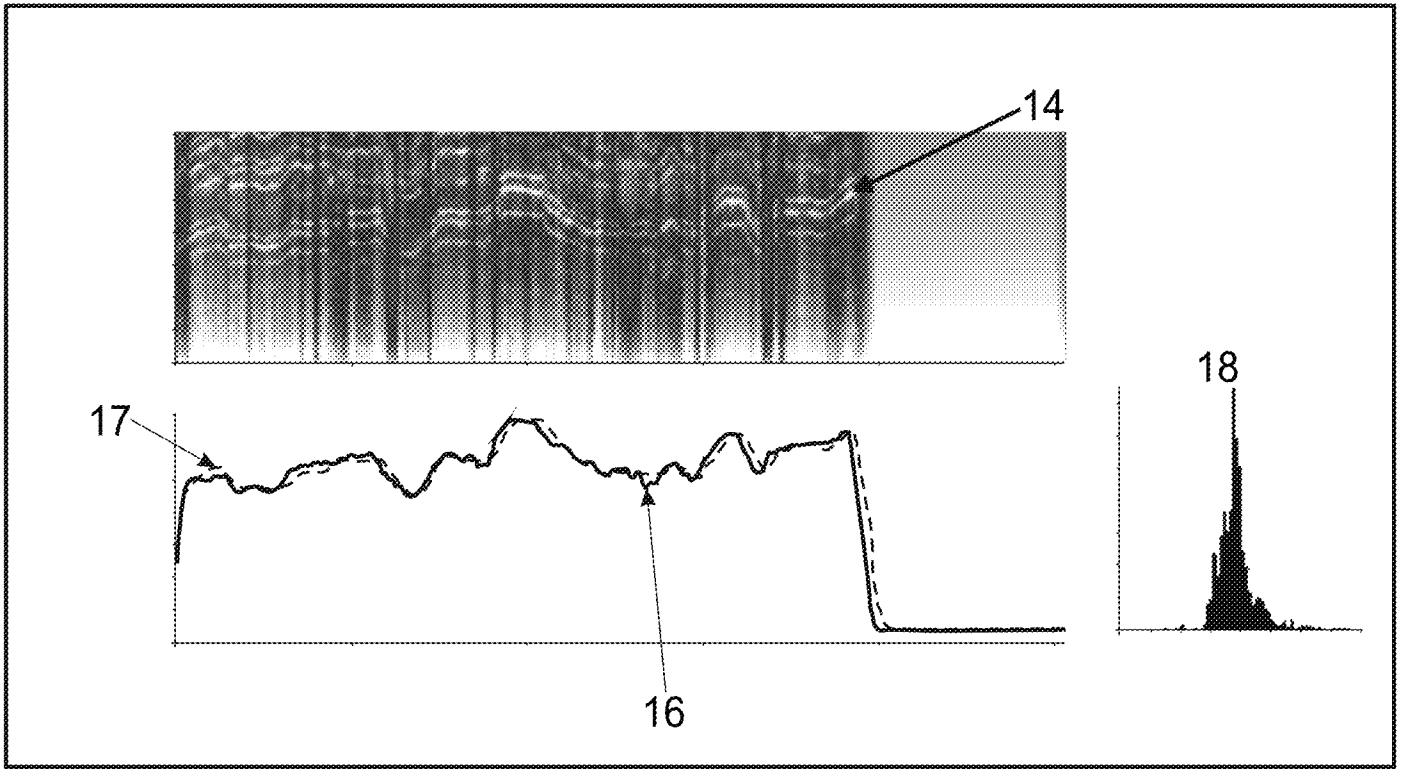
FIG. 6: shows an acceleration spectrogram, the determined ground speed and a residual representation.

FIG. 6 shows the comparison with the diagram shown in FIG. 4 together with the residual representation 18. A trained or retrained convolutional neural network 11 is applied to an acceleration spectrogram 14, which has the filtered and normalized vibration data 5, and the ground speed (prediction 16) is displayed in comparison to the GPS speed as a ground truth speed 17.

Due to the filtering and the normalization, the residual representation 18 has an error of less than +/−two and a half meters per second (2.5 m/s). Due to the retraining, this can be permanently maintained and the error no longer increases.

Figure 7:
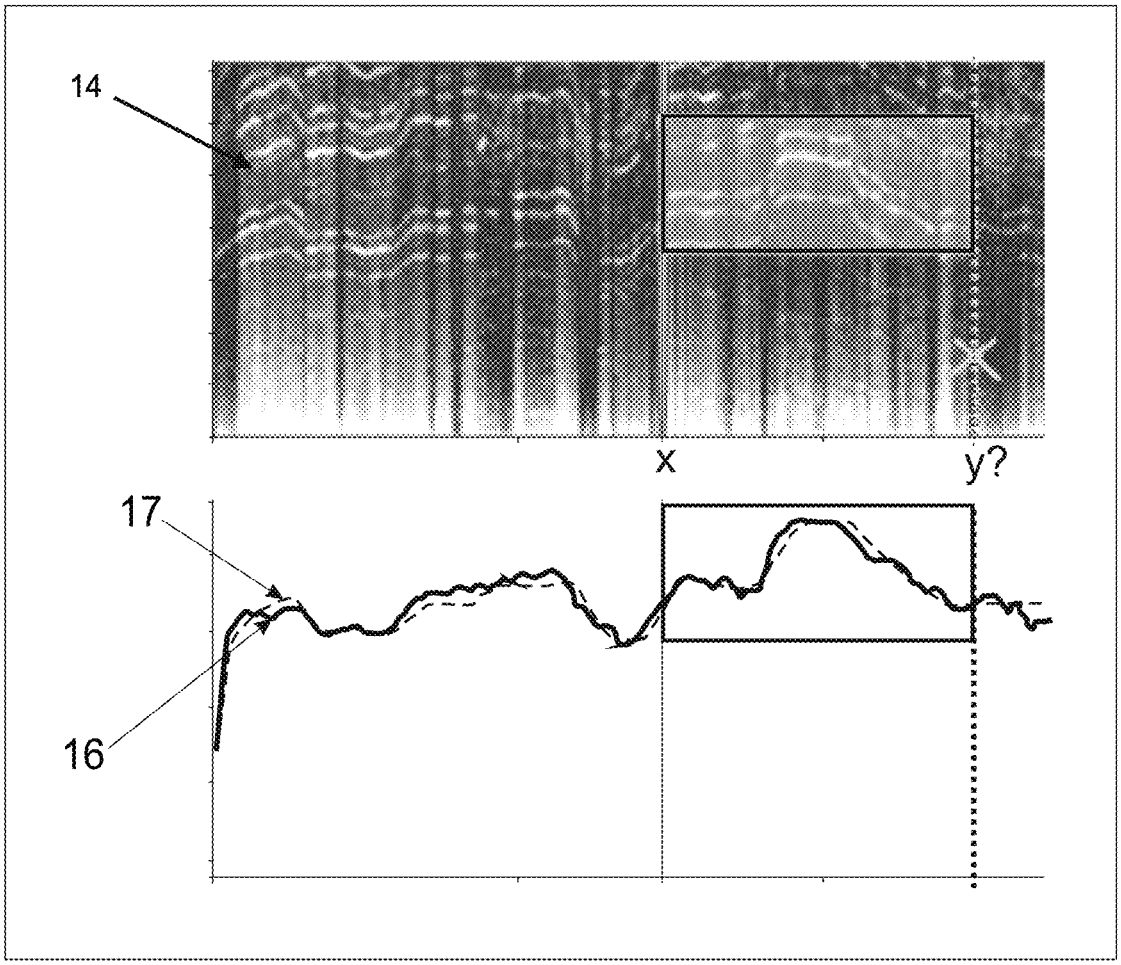
FIG. 7: shows the application of the method according to example aspects of the invention and the device.

FIG. 7 shows an example of the application of the method according to example aspects of the invention and the device 9.

An acceleration spectrogram 14 is shown with speed-dependent spectral lines. These lines correlate with the ground speed.

Using the trained convolutional neural network 11, the ground speed can now also be predicted in tunnels. If the train 1 is located at a first position at the point in time x, the position y in the tunnel can be predicted on the basis thereof by utilizing the time and the distance traveled.

Furthermore, all wheels of the train 1 can be equipped with sensors 2*a*, . . . , 2*d*.

On the basis of the acceleration spectrogram 14 and the ground speed, which has been determined by the convolutional neural network 11, the wear of each individual wheel can now be determined.

FIG. 8 shows the wear of a wheel in table form. After the wheels become worn, the wheels must rotate faster in order to truly have the same ground speed as prior to the wear. This yields a frequency shift in the acceleration spectrogram 14.

In order to measure the wear, speed-dependent parameters, such as the toothing frequencies of a transmission or wheel frequencies of each wheel, for a known wheel diameter and for the new wheel diameter are compared, specifically at the same speed in each case.

The diagram shows the first gearmesh frequency of 81.6 Hz at a wheel diameter of 715 mm. In the case of a worn wheel having a diameter of 635 mm, the first gearmesh frequency is 91.9 Hz. The ground speed is 5 km/h in each case in this comparison.

If the ground speed is, for example, 40 km/h, the first gearmesh frequency is 652.9 Hz at a wheel diameter of 715 mm and shifts to 735.2 Hz for a worn wheel having a diameter of 635 mm. The worn wheel must therefore rotate faster in order to reach the same ground speed.

Therefore, the curves of the frequency shift of the speed-dependent parameters, for example, on the basis of the gearmesh frequency, or the multiple of the wheel frequency in the acceleration spectrogram 14 can be compared from time to time at the same ground speed in each case in order to estimate the wear, i.e., the wear is estimated on the basis of the "computational frequency shift."

Due to the method according to example aspects of the invention and the device 9, the ground speed of a rail-based vehicle can be determined on the basis of an acceleration spectrogram 14 by a convolutional neural network 11, regardless of the position of the train 1, for example, also in tunnels. The estimation of speed can therefore be used to locate a train 1 and/or to estimate the position of a train 1 and/or to determine the rail position and/or to carry out rail monitoring.

Furthermore, this method and the device 9 can be used, once the ground speed has been determined, to determine the wear of the individual wheels on the basis of the acceleration spectrogram 14.

Figure 9:
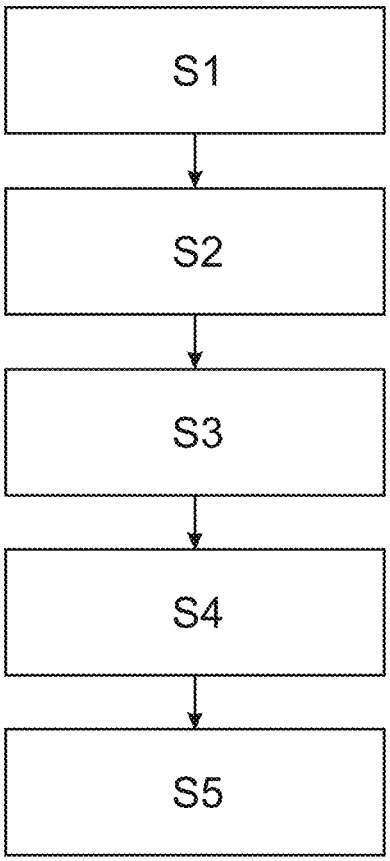
FIG. 9: shows a method for generating training data.

FIG. 9 schematically shows a method for generating training data which are suitable for determining a ground speed of a rail-based vehicle with wheels on a predetermined network of routes.

In a first step S1, the acceleration of the rail-based vehicle can be detected as one-dimensional or multi-dimensional vibration data due to vibrations, of at least one of the wheels, acting on the rail-based vehicle using a wireless sensor, which is arranged in the region of the at least one wheel.

In another step S2, a raw spectrogram 10 is generated by applying an acoustic analysis such as, for example, a Fourier transform, to the vibration data.

In another step S3, a filtering is applied to the raw spectrogram 10 and, thereafter, normalization is applied in order to generate an acceleration spectrogram 14 on the basis of the time-resolved, normalized, filtered vibration data.

Thereafter, in a step S4, ground truth speeds 17 are generated on the basis of received GPS positions, the distance traveled and the time when the rail-based vehicle passes through position alarm points.

In a step S5, the machine learning method is trained with respect to the acceleration spectrogram 14 in order to determine the ground speed by utilizing the ground truth speed 17 and the corresponding portion of the acceleration spectrogram 14 and the distance traveled as well as the time.

Alternatively, step S2 and step S3 can be omitted and, instead of the acceleration spectrogram 14, the time-resolved vibration data can be used.

Other methods for generating training data can also be used or can be combined with this method.

A bandpass filter and, thereafter, a median filter can be applied as filtering. In this way, the vibration data can be optimally preprocessed.

The ground truth speed 17 can be easily determined (above ground) as a GPS speed in geofence regions. The ground truth speed 17 can also be determined via a speed measurement, wheel revolution per unit of time. The ground truth speed 17 can also be determined via GPS positions.

Modifications and variations can be made to the embodiments illustrated or described herein without departing from the scope and spirit of the invention as set forth in the appended claims. In the claims, reference characters corresponding to elements recited in the detailed description and the drawings may be recited. Such reference characters are enclosed within parentheses and are provided as an aid for reference to example embodiments described in the detailed description and the drawings. Such reference characters are provided for convenience only and have no effect on the scope of the claims. In particular, such reference characters are not intended to limit the claims to the particular example embodiments described in the detailed description and the drawings.

LIST OF REFERENCE CHARACTERS

1 train
2*a*,2*b*,2*c*,2*d* sensor
3 transmission
4 bogie
5 vibration data
6 telematics gateway
7 cloud
8 interface
9 device
10 raw spectrogram
11 convolutional neural network
12 bandpass filter
13 median filter
14 acceleration spectrogram
15 normalization
16 prediction
17 ground truth speed
18 residual representation

The invention claimed is:

1. A device (9) for determining a speed of a rail-based vehicle with wheels on a predetermined network of routes, comprising:

an interface (8) for collecting vibration data (5) corresponding to vibrations of at least one wheel, the vibrations acting on the rail-based vehicle as an acceleration of the rail-based vehicle;

at least one wireless sensor (2*a*, 2*b*, 2*c*, 2*d*) arranged proximate the at least one wheel and configured for detecting the vibrations and generating the vibration data (5) based on the vibrations detected; and at least one computing unit configured for applying a trained machine-learned model to the vibration data in order to determine the ground speed, wherein the trained machine-learned model is trained based on a distance traveled, a ground truth speed (17), and a corresponding portion of the vibration data (5).

2. The device (9) of claim 1, wherein the at least one computing unit is further configured for:

applying an acoustic analysis to the vibration data (5) in order to generate a raw spectrogram (10);

applying a filter to the raw spectrogram (10); and after the filtering, applying normalization (15) to generate an acceleration spectrogram (14), wherein the trained machine-learned model is trained for application to the acceleration spectrogram (14) in order to determine the ground speed.

3. The device (9) of claim 2, wherein the at least one computing unit is configured to form a short-time Fourier transform (STFT) as an acoustic analysis of one or both of the raw spectrogram (10) and the acceleration spectrogram (14).

4. The device of claim 2, wherein the at least one computing unit is configured for filtering the raw spectrogram (10) by applying one or more of a high-pass filter, a low-pass filter, a bandpass filter, and a median filter (13).

5. The device (9) of claim 1, wherein the at least one computing unit is configured for receiving GPS positions of the rail-based vehicle, and the at least one computing unit is configured to determine the ground truth speed (17) based on the GPS positions.

6. The device (9) of claim 1, wherein the at least one computing unit is configured to generate the corresponding ground truth speed (17) when the rail-based vehicle passes through position alarm points.

7. The device (9) of claim 1, wherein the at least one computing unit is configured to continuously retrain the trained machine-learned model based on the determined ground speed and the ground truth speed (17).

8. The device (9) of claim 1, wherein the at least one computing unit is configured to determine a wheel position and/or rail position based on the network of routes, a required time, and the determined ground speed.

9. The device of claim 1, wherein the at least one computing unit is configured for applying one or more of a high-pass filter, a low-pass filter, a bandpass filter, and a median filter (13).

10. The device (9) of claim 1, wherein the at least one computing device is configured to train the machine-learned model based on the distance traveled, the corresponding ground truth speed (17), and the corresponding portion of the vibration data (5), wherein the ground truth speed (17) is generated based on transmitted GPS positions.

11. A method for determining a ground speed of a rail-based vehicle with wheels on a predetermined network of routes, comprising:

detecting an acceleration of the rail-based vehicle as one-dimensional or multi-dimensional vibration data (5) corresponding to vibrations of at least one of the wheels acting on the rail-based vehicle using a wireless sensor (2*a*, 2*b*, 2*c*, 2*d*) arranged proximate each of the at least one wheel;

applying a trained machine-learned model to the vibration data (5) in order to determine a ground speed, wherein the trained machine-learned model is trained based on a distance traveled, a corresponding ground truth speed (17), and a corresponding portion of the vibration data (5).

12. The method of claim 11, further comprising:

applying an acoustic analysis to the vibration data in order to generate a raw spectrogram (10);

applying a filter to the raw spectrogram (10); and after the filtering, applying a normalization (15) in order to generate an acceleration spectrogram (14), and wherein the trained machine-learned model is trained for application to the acceleration spectrogram (14) in order to determine the ground speed.

13. The method of claim 11, wherein the corresponding ground truth speed (17) is generated when the rail-based vehicle passes through position alarm points.

14. The method of claim 11, further comprising determining a wheel position and/or a rail position based on the ground speed, a required time, and the network of routes.

15. The method of claim 11, applying one or more of a high-pass filter, a low-pass filter, a bandpass filter, and a median filter (13).

16. The method of claim 11, further comprising retraining the trained machine-learned model based on the determined ground speed and the ground truth speed (17).

17. The method of claim 11, wherein the ground truth speed (17) is generated based on transmitted GPS positions.

18. The method of claim 11, further comprising:

determining at least one current speed-dependent parameter for calculating a wheel diameter of the at least one wheel based on the vibration data; and determining wear by comparison with corresponding original speed-dependent parameters for an original wheel diameter, wherein the current speed-dependent parameter and the original speed-dependent parameter are both based on the same or approximately the same ground speed.

19. The method of claim 18, wherein one or both of toothing frequencies of a transmission (3) and wheel frequencies of the at least one wheel are used as a current speed-dependent parameter, wherein the wear of the at least one wheel is determined based on a frequency shift in the acceleration spectrogram (14).

* * * * *